United States Patent [19]

Conley

[11] Patent Number: 4,496,204

[45] Date of Patent: Jan. 29, 1985

[54] BOOSTER CABLE ASSEMBLY

[76] Inventor: William J. Conley, 36 Hervey St., Brockton, Mass. 02401

[21] Appl. No.: 480,319

[22] Filed: Mar. 30, 1983

Related U.S. Application Data

[63] Continuation-in-part of Ser. No. 21,957, Mar. 19, 1979, abandoned.

[51] Int. Cl.[3] ..... H01R 11/22

[52] U.S. Cl. ..... 339/29 B; 174/69

[58] Field of Search ..... 339/28, 29, 148; 320/25, 26; 174/136, 69

[56] References Cited

U.S. PATENT DOCUMENTS

| | | | |
|---|---|---|---|
| 380,829 | 4/1888 | Swarts | 339/148 |
| 688,970 | 12/1901 | Saylor | 174/136 |
| 896,700 | 8/1908 | Atwood | 339/148 |
| 1,574,297 | 2/1926 | Lilleberg | 339/148 |
| 2,654,077 | 9/1953 | McLoad | 339/148 |
| 3,259,754 | 7/1966 | Matheson | 320/25 |

*Primary Examiner*—Neil Abrams

*Attorney, Agent, or Firm*—Andrew F. Kehoe

[57] ABSTRACT

Novel dual conduit clamp assembly of particular use in starting storage batteries. The assembly is one of the type known as a "jump cord" assembly and is characterized by (1) a smaller spacing of positive and negative clamps at one end thereof and (2) a substantially larger spacing of clamps at the other end thereof.

5 Claims, 2 Drawing Figures

BOOSTER CABLE ASSEMBLY

RELATED APPLICATION

This patent application is a continuation-in-part of copending application Ser. No. 21,957 filed on Mar. 19, 1979 now abandoned.

BACKGROUND OF THE INVENTION

This invention relates to an improved booster cable assembly, e.g. an assembly used in starting a battery of one automobile by utilizing direct current from the battery of another automobile.

There are known to be a number of problems associated with the use of booster cables or "jump cords" as they have previously been constructed. The primary problem is that the user may connect the wires to the wrong terminals or in the wrong order and, in some cases, cause the gases in the battery to explode. Often the terminal intended for grounding on the automotive frame is connected to the terminal of a battery. This presents a substantial risk of creating a spark which will explode the battery gases. The most common configuration of booster cables known in the art is a pair of conduits of equal length, but usually colored to distinguish one from the other. It is also known to fasten the two conduits together over a major portion of their length. Again color is relied upon as the primary way to identify what clamps are on a given conduit.

Neither of the configurations provide any structural feature which decreases the significant number of injuries resulting each year from misuse of booster cables.

The problem of booster cable safety is multi-faceted and much discussed in the literature. See *Consumer Reports* of January 1979 including articles on "Battery Booster Cables" and "How to Use Booster Cables Safely". See also the article entitled "The Bomb Under the Hood" published in the *Journal of American Insurance,* Vol. 56, No. 3. Both of these articles emphasize the safety aspect of making the last connection to a ground, preferably, an engine block as does the Fact Sheet No. 82 relating to batteries and published in a revised version in January 1977 by the U.S. Consumer Product Safety Commission.

The last-mentioned two articles use italics to point out the urgency of the warning. The urgency is further emphasized by the statistics on injuries, usually eye injuries, presented in the *Journal of American Insurance* (about 21,000 injuries from batteries in 1979, representing a 30 percent increase from 1978) and in such articles as "Batteries Boost Eye Injuries" in *The Sight-Saving Review* (Spring 1977 issue, published by the National Society for the Prevention of Blindness).

These reports have resulted in numerous attempts to improve safety by changing battery design. These reports have resulted in numerous attempts to develop labels and marking means to alert users of booster cables to their proper use. The latter attempts have been largely unsuccessful, very probably because a lot of battery-boosting goes on after dark. (Quite a number of injuries have occured from matches being used as a light-source preliminary to connecting booster cables.) The aforesaid *Consumer Reports* article (January 1979) discusses booster cable design very specifically and with safety as the principle criterion for rating their use. Yet, nothing in that article suggested that a new construction of the booster cable could be used as a means to instruct and remind the user in their use.

SUMMARY OF THE INVENTION

It is a principal object of the invention to provide an improved booster cable assembly and particularly an assembly constructed in such a way as to encourage and facilitate safe use of such an assembly.

It is a further embodiment of the invention to provide a safer means to use booster cables.

Another object of the invention is to provide a jump cord requiring substantially less conduit.

Other objects of the invention will be obvious to those skilled in the art on their reading of this invention.

The above objects have been substantially achieved by providing a jump wire (or battery-booster cable) assembly wherein the cords, although joined together for a substantial part of their length are separated from one another at each end of the assembly. More importantly, the assembly is so constructed that (1) the separation of the clamps at one end is relatively little, e.g. no more than would be appropriate to facilitate connection of the two clamps to one battery while (2) the separation of the clamps at the other end is much greater and, indeed, is sufficient to discourage, or at least suggest as inappropriate, an attempt to connect both terminals, at this other end, to the other battery. Thus one cable, that intended for attachment to ground, will be so much longer or shorter than the cable intended for connection to the positive cable of the battery that the user will be reminded of the fact that both cables are not to be attached to the second battery. It is preferably that the "ground" cable be longer to facilitate its connection to ground.

Moreover, as an additional safeguard, it is desirable to have some marking on each cable. Reliance on the conventional color code is believed to be undesirable because often the jump-cord assembly is used after dark. Moreover, the new structure for the first time, removes what has heretofore been a not-very-valuable option to use either cord as the positive or negative cord. Dedicating one cable to use with positive terminals, therefore, becomes wholly feasible and only tends to further inhibit misuse of the jumpcord.

ILLUSTRATIVE EMBODIMENT OF THE INVENTION

For a fuller understanding of the nature and objects of the invention, reference should be had to the following detailed description taken in connection with the accompanying drawing, which is a perspective on one embodiment of the invention.

Figure 1:
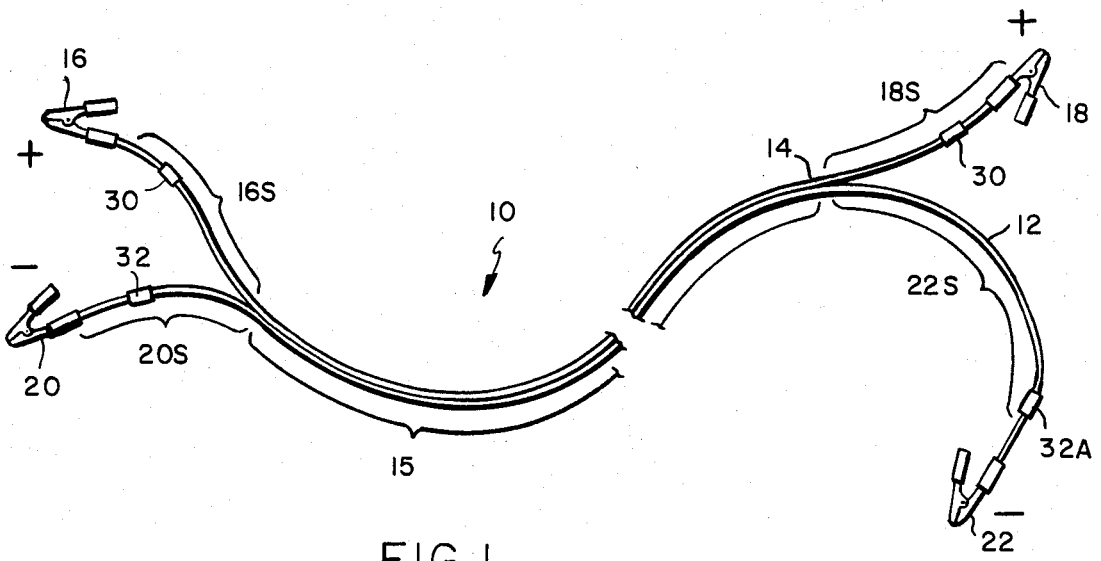
FIG. 1 shows the terminal portions of a booster cable assembly according to the invention.

Referring to FIG. 1, it is seen that a jump-wire assembly 10 comprises a first wire 12 which is a longer wire than a second wire 14, whih is attached to wire 12 over a major portion 15 of the length of assembly 10. Wire 14 carries, at its terminal points, electroconductive clamps 16 and 18 which may be of the kind conventionally used in jump-wire i.e. booster cable, sets. Similarly, clamps 10 and 22 are attached to wire 12. The conduit lengths 16*s* and 20*s* which allow independent movement of clamps 16 and 10 are so selected to facilitate the attachment of both clamps 16 and 20 to a single battery. They may be of the same length or differ slightly.

However, the conduit segments 18*s* and 22*s* are substantially different lengths after they part from common-conduit segment 15. It is, therefore, convenient to attach segment 18*s* to the positive terminal of a battery, but leaving segment 22*s* long enough, say from 12 to 30 inches longer than 18*s*, to allow the user to find an easy connection to ground.

It is noted that, because of the desirability of attaching clamp 22 to ground, one may consider that conduit to be dedicated to a negative attachment at clamp 20. Thus, unlike previous booster cable assemblies, one may suitably provide positive identification means on one or both of the cables. Thus markers 30 on cable 14 can be used to identify that cable as dedicated to connection between positive battery terminals. Markers 32 and 32*a* could be used to provide markers indicative of negative connection and ground, respectively.

Figure 2:
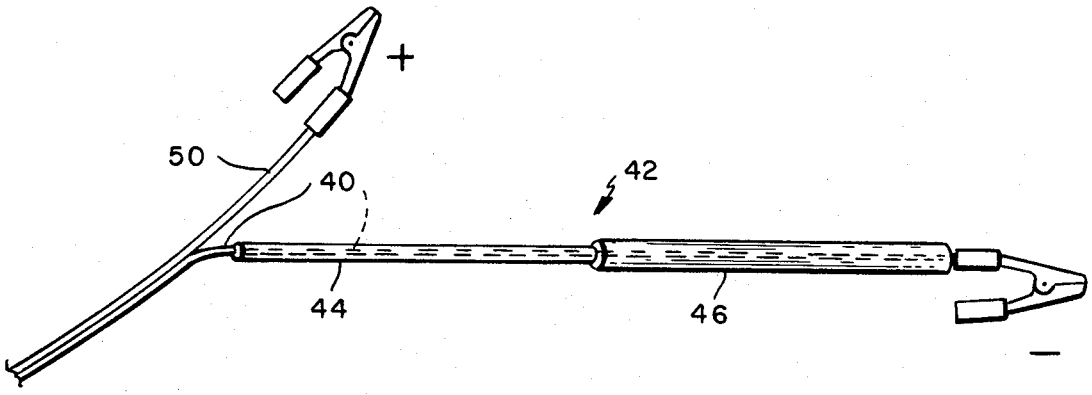
FIG. 2 shows a variation in the apparatus of FIG. 1 at one end thereof.

Referring to FIG. 2, it is seen that the longest connecting line 40 is contained within a telescoped reinforcing member 42 comprising a slideable, but snug, fit between inner tube 44 and outer sleeve 46. This reinforcing member 42 forms means to better enable a user to place the lead to a ground away from the battery without its coming in contact with hot surfaces or moving parts. The lengths of each extended portions of the telescoped tubes are about one foot long. The extended cable connection 40 is typically about three times as long as the non-extended cable 50.

Those skilled in the art will understand that a number of combinations of marker systems is possible. What is unique is the dedication of one conduit to ground thereby making a marking system useful which relates not merely to specifying conduit (e.g. the green and red markings common in the prior art) but to defining the use of the conduits with respect to the particular battery connections, themselves.

It is further to be understood that the following claims are intended to cover all of the generic and specific features of the invention herein described.

What is claimed is:

1. In a booster-cable assembly of the type used to start automotive batteries, and formed of two conduits, each with a clamp means on each end thereof, the improvement wherein said conduits are joined in a common elongated segment over a major portion of their lengths, wherein each conduit comprises terminal segments, at each end thereof, for independent movement at each end of said common segment, and wherein the terminal segments at first end thereof differ substantially in length one from the other; wherein the terminal segments suitable for independent movement at the other end of said assembly are about equal in length with each other and with said shorter terminal segment at said first end thereof, wherein a longer terminal segment at said first end thereof is at least two times longer than said shorter terminal segment, and wherein said longer terminal cable comprises a reinforcing tube thereover, said tube comprising telescoped members, slidable, and snugly fitting one into the other and forming means to straighten said longer terminal segment.

2. A cable assembly as defined in claim 1 wherein shorter terminal segment comprises a "positive-terminal" marker.

3. A cable assembly as defined in claim 1 where a longer terminal segment comprises a "ground" marker.

4. An assembly as defined in claim 1 wherein said longer cable is about three times as long as said shorter terminal cable segment.

5. An assembly as defined in claim 1 wherein said longer cable is about three times as long as said shorter terminal segment.

* * * * *